United States Patent [19]

Wildt

[11] Patent Number: 4,913,911

[45] Date of Patent: Apr. 3, 1990

[54] EMBOSSING MACHINE FOR TEXTILE MATERIALS

[75] Inventor: Eberhard Wildt, Grenzach-Wyhlen, Fed. Rep. of Germany

[73] Assignee: Robert Casaretto Walzengravieranstalt und Walzenfabrik GmbH & Co. KG, Grenzach-Wyhlen, Fed. Rep. of Germany

[21] Appl. No.: 309,381

[22] Filed: Feb. 10, 1989

[30] Foreign Application Priority Data

Feb. 13, 1988 [DE] Fed. Rep. of Germany ..... 3804611

[51] Int. Cl.[4] ..... B29C 53/26

[52] U.S. Cl. ..... 425/385; 156/209; 156/219; 156/462; 156/472; 264/119; 264/284; 264/285; 425/396

[58] Field of Search ..... 156/62.6, 166, 209, 156/219, 435, 437, 462, 472; 264/119, 280, 284, 285; 425/385, 396, 458

[56] References Cited

U.S. PATENT DOCUMENTS 4,627,137 12/1986 Wildt ..... 29/121.2

FOREIGN PATENT DOCUMENTS 0007665 2/1980 European Pat. Off. .
2518531 3/1976 Fed. Rep. of Germany .
2518532 3/1976 Fed. Rep. of Germany .

*Primary Examiner*—Jay H. Woo
*Assistant Examiner*—Timothy W. Heitbrink
*Attorney, Agent, or Firm*—Peter K. Kontler

[57] ABSTRACT

An embossing machine wherein two driven embossing rolls are provided with peripheral knobs and depressions. The knobs of one roll extend with clearance into the depressions of the other roll and vice versa during travel of the knobs and depressions through the nip of the rolls. The clearances between the top lands of knobs and adjacent portions of internal surfaces bounding the respective depressions are smaller than the clearances between the flanks of the knobs and the adjacent portions of the respective internal surfaces. This ensures that a carpet of loose fibrous material which is fed into the nip is converted into embossed textile material having a first layer of compacted portions which are formed adjacent the top lands of knobs on one of the rolls, a second layer of compacted portions which are formed adjacent the top lands of knobs on the other roll, and fluffy intermediate portions which connect the compacted portions forming one of the layers with compacted portions of the other layer. The knobs of one or both rolls can be heated to weld the filaments of the compacted portions to each other. Alternatively, or in addition to heating, those parts of the carpet which are to be converted into compacted portions can be impregnated or sprayed with a suitable solvent. The height of the knobs determines the thickness of the embossed textile material.

20 Claims, 2 Drawing Sheets

EMBOSSING MACHINE FOR TEXTILE MATERIALS

BACKGROUND OF THE INVENTION

The invention relates to machines for making embossed textile materials, and more particularly to improvements in machines wherein the embossing of a carpet or a like accumulation of loose fibrous material (hereinafter called fleece for short) takes place during advancement through the nip of two embossing rolls.

Commonly owned U.S. Pat. No. 4,627,137 discloses an embossing machine wherein a smoothsurfaced embossing roll cooperates with a second roll having a peripheral surface provided with knobs to condense selected portions of a fleece which is caused to advance through the nip of the two rolls. An advantage of such machines is that the roll which has a smooth peripheral surface can be produced, and its peripheral surface finished, at a relatively low cost. However, such machines also exhibit certain drawbacks, especially as concerns the maximum achievable thickness of the embossed textile material and the quality and condition of the less compacted portions which surround the condensed portions of the fleece.

It was further proposed to advance a fleece through the nip of two embossing rolls each of which is provided with peripheral knobs. The knobs of one of the rolls register, at least in part, with the knobs of the other roll during travel through the nip of the two rolls. This enhances the compacting action upon selected portions of the fleece, namely upon those portions which happen to advance between pairs of registering knobs during travel through the nip. Such embossing apparatus are not capable of producing an embossed textile material having a thickness which exceeds the thickness of the fleece, i.e., the thickness of the starting material. Moreover, the quality (especially the thickness) of compacted portions of the fleece is overly dependent upon the accuracy of finish of knobs on the two embossing rolls. Thus, even minor deviations of the dimensions of knobs on at least one of the rolls from optimum dimensions will result in the making of an embossed textile material wherein the thickness of compacted portions can vary within a rather wide range. In addition, the cost of embossing rolls is high. Still further, elastic deformation of rolls during the passage of fleece through the nip of the rolls also affects the quality of the thus obtained embossed textile material. Such elastic deformation can exert a pronounced influence upon the quality of the textile material in the middle of the nip, and the effect of elastic deformation upon the quality of the embossed textile material is compounded by the weight of the rolls as well as by the sizes of the knobs. Textile materials which can be produced in embossing machines of the just outlined character are disclosed in German Auslegeschriften Nos. 25 18 531 and 25 18 532 of Cumbers et al.

European patent application No. 0 007 665 of Aziz discloses a machine for embossing pretreated textile materials. The machine employs a pair of embossing rolls each of which is provided with knobs, and the knobs on one of the rolls are staggered with reference to knobs of the other roll so that the pretreated textile material which passes through the nip of such rolls is provided with two layers of compacted portions and with compacted intermediate portions which connect the compacted portions of one layer with the compacted portions of the other layer. The clearances between the external surfaces of the knobs and the internal surfaces bounding the complementary depressions for the knobs are dimensioned in such a way that the compacting action upon the intermediate portions of the pretreated textile material which is caused to advance through the nip of the rolls is more pronounced than upon the portions which form the two layers. This adversely affects certain desirable characteristics of the twice treated textile material, particularly the absorbency of intermediate portions and the softness and suppleness of the ultimate product. The starting material is a precompressed layer of nonwoven textile material.

OBJECTS OF THE INVENTION

An object of the invention is to provide a novel and improved embossing machine which can convert a fleece of loose fibrous material into an embossed textile material in a single operation and in such a way that the characteristics of embossed textile material (particularly its thickness, suppleness, softness and absorbency) are superior to the corresponding characteristics of embossed textile materials which are produced in heretofore known machines.

Another object of the invention is to provide novel and improved embossing rolls for use in the above outlined machine.

A further object of the invention is to provide a novel and improved method of converting a fleece of filaments into an embossed textile material which exhibits the above outlined characteristics.

An additional object of the invention is to provide a machine wherein predetermined portions of the fleece can be compacted and/or otherwise treated with a high degree of precision and predictability irrespective of the size and/or configuration and/or distribution of such predetermined portions.

Still another object of the invention is to provide an embossing machine wherein the fluffiness of certain portions of the fleece remains intact or is even enhanced in the course of the embossing operation.

A further object of the invention is to provide a novel and improved textile material which can be obtained in the above outlined embossing machine.

SUMMARY OF THE INVENTION

The invention is embodied in a machine for embossing a fleece of fibrous material, e.g., a fleece which consists of or contains thermoplastic filaments. The improved machine comprises first and second rotary embossing rolls which define a nip for the fleece of fibrous material and have peripheral surfaces provided with projections (hereinafter called knobs) and depressions. The knobs of the first roll extend with clearance into the depressions of the second roll, and the knobs of the second roll extend with clearance into the depressions of the first roll during travel of the knobs and depressions through the nip of the two rolls. The knobs have top lands and flanks, and the rolls have internal surfaces bounding the depressions in their peripheral surfaces. The clearances between the flanks and the internal surfaces bounding the respective depressions are greater than the clearances between the top lands of the knobs and the internal surfaces bounding the respective depressions during travel of the knobs and depressions through the nip. This ensures that the embossed textile material, into which the fleece is converted during travel through the nip, is formed with fluffy intermediate portions which connect compacted portions of the embossed material. The compacted portions are formed by the top lands in cooperation with the adjacent portions of the respective internal surfaces, and the fluffy intermediate portions are formed around the flanks of the knobs during travel of the fleece through the nip.

The embossing machine further comprises means for driving at least one of the rolls so that the rolls rotate in opposite directions; such driving means can include means for transmitting torque to one or both rolls or means for pulling the fleece through the nip of the rolls so that the fleece rotates the rolls in opposite directions.

The axes of the rolls may but need not be parallel to each other, depending upon whether the rolls have cylindrical or conical peripheral surfaces.

The internal surfaces of the rolls preferably include smooth (precision finished) portions which confront the top lands of the respective knobs during travel of depressions and knobs through the nip.

If the fleece has a predetermined thickness, the width of clearances between the flanks of knobs and the internal surfaces bounding the respective depressions during travel through the nip can equal or approximate (e.g., exceed) the thickness of the fleece.

Each knob has a root portion which is remote from the respective top land and where the knob merges into the major part of the respective roll. The flanks of the knobs preferably diverge in a direction from the top lands toward the respective root portions. The angles of divergence of all flanks can but need not be the same. For example, each angle of divergence can be between 15° and 45°, preferably between 20° and 30°.

The width of clearances between the flanks of the knobs and the adjacent portions of the respective internal surfaces can be at least substantially constant.

At least some of the knobs can constitute pyramids, particularly truncated pyramids (pyramidal frusta) with square or rectangular top lands. Alternatively, at least some of the knobs can constitute cones, particularly conical frusta with circular or oval top lands.

The root portions of at least some of the knobs (such as the aforementioned knobs resembling or constituting truncated pyramids) can have a square or rectangular outline with one of the diagonals extending in substantial parallelism with the axis of the respective roll.

The top lands of the knobs can be elongated, and the top lands of knobs on one of the rolls can be inclined with reference to the top lands of knobs on the other roll. For example, the top lands of knobs on the one roll can be substantially normal to the top lands of knobs on the other roll. The arrangement may be such that the top lands of knobs on the one roll are substantially normal to the axis of the one roll, and the top lands of knobs on the other roll are substantially parallel to the axis of the other roll.

It is also possible to select the orientation of square or rectangular root portions of at least some of the knobs on at least one of the rolls in such a way that both diagonals of such square or rectangular outlines are inclined with reference to the axis of the at least one roll. Such diagonals can be further inclined with reference to a plane which is normal to the axis of the at least one roll.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
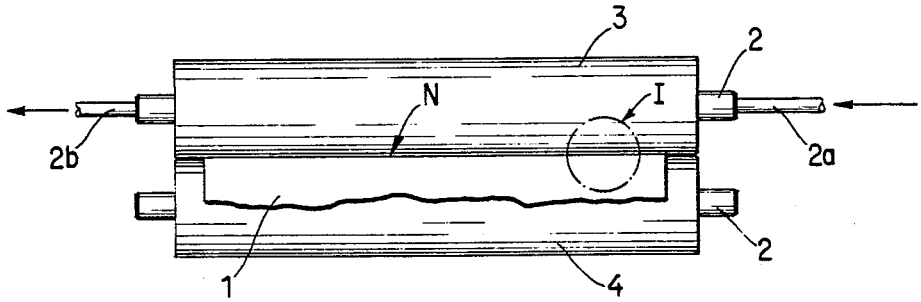
FIG. 1 is a schematic elevational view of a portion of an embossing machine which embodies one form of the invention, a portion of a carpet of fleece which is to be converted into an embossed textile material being shown upstream of the nip of the two embossing rolls.

FIG. 1 shows two embossing rolls 3 and 4 which define a nip N and are rotatable about the axes of two parallel drive shafts 2 which serve to rotate the rolls 3 and 4 in opposite directions to thus advance a carpet-like fleece 1 of filamentary material through the nip N in a direction at right angles to the plane of FIG. 1. Selected portions of the fleece 1 are treated to a different extent and in different ways, and such treatment can be enhanced by heat (FIG. 1 shows a conduit 2*a* which serves to admit a heating fluid into the roll 3, and a conduit 2*b* which serves to evacuate spent heating fluid from the interior of the roll 3) and/or by the application of a suitable solvent or softening agent. The exact nature of the agent depends upon the intended treatment of the respective portion of the fleece 1 and/or upon the composition of the material of filaments which form the fleece.

The peripheral surface of the roll 3 is formed with axially parallel rows of projections or knobs 7 (FIG. 2) which are received with clearance in complementary recesses 10 of the peripheral surface of the roll 4 during travel through the nip N, and the peripheral surface of the roll 4 has projections or knobs 8 extending with clearance into complementary depressions 9 in the peripheral surface of the roll 3 during travel of knobs 8 and depressions 9 through the nip N.

The clearances between the top lands 5 of knobs 7 and the adjacent portions of internal surfaces 8*a* bounding the depressions 10 in the peripheral surface of the roll 4 are narrower than the clearances between the flanks 13 of the knobs 7 and the adjacent portions of the respective internal surfaces 8*a*. Analogously, the clearances between the top lands 6 of the knobs 8 and the adjacent confronting portions of internal surfaces 7*a* bounding the depressions 9 are narrower than the clearances between the flanks 13 of the knobs 8 and the adjacent portions of internal surfaces 7*a*. Portions of internal surfaces 7*a* constitute the flanks 13 of the knobs 7, and portions of internal surfaces 8*a* constitute the flanks 13 of the knobs 8.

Figure 3:
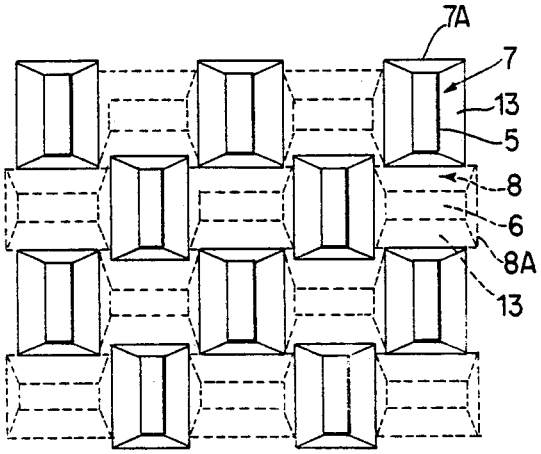
FIG. 3 is a fragmentary developed view of the embossing rolls, showing the patterns of knobs and depressions in their peripheral surfaces, the developed view of one of the rolls being superimposed upon the developed view of the other roll.
Figure 5:
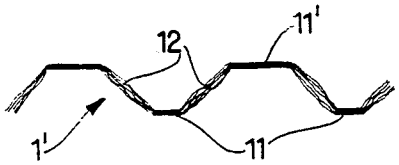
FIG. 5 is a sectional view of an embossed textile material which can be obtained in the machine employing rolls of the type shown in FIGS. 3 and 4.

The just described selection of the width of clearances between the knobs 7, 8 on the one hand and the internal surfaces 8*a*, 7*a* on the other hand ensures that the fleece 1 is converted into an embossed textile material 1' (FIG. 5) having a first layer of discrete compacted portions 11 in a first plane, a second layer of discrete compacted portions 11' in a second plane which is spaced apart from the first plane, and fluffy intermediate portions 12 which connect the compacted portions 11 of the one layer with the compacted portions 11' of the other layer. As can be seen in FIG. 3, the top lands 5 of the knobs 7 have a rectangular outline and are elongated in directions at right angles to the axis of the roll 3. On the other hand, elongated rectangular top lands 6 of the knobs 8 extend in parallelism with the axis of the roll 4. The diagonals of square or rectangular root portions 7A of the knobs 7 are inclined with respect to the axis of the roll 3 as well as with reference to a plane which is normal to such axis. The same applies for the diagonals of square or rectangular outlines of root portions 8A of the knobs 8 on the roll 4. It is assumed that the axes of the rolls 3 and 4 having the knobs 7 and 8 of FIG. 3 are parallel to each other and are horizontal. The knobs 7 of successive rows of such knobs alternate with the knobs 8 of successive rows of knobs 8 during travel through the nip N. This ensures that the fleece 1 is converted into a textile material 1' the first side of which is provided with hollow bosses (formed by the knobs 7) having bottom walls which are constituted by the compacted portions 11, and the second side of which is provided with hollow bosses (formed by the knobs 8) having bottom walls which are constituted by the compacted portions 11'. The fluffy intermediate portions 12 constitute the sidewalls of such hollow bosses and are inclined with reference to the planes of compacted portions 11 and 11'. This ensures that the fluffiness of intermediate portions 12 increases in response to deformation of the embossed textile material 1', namely in response to movement of the layer of compacted portions 11 toward the layer of compacted portions 11' and/or vice versa. The width of clearances for the fluffy intermediate portions 12 of embossed textile material can equal or even exceed the thickness of fleece 1 which is being fed into the nip N, i.e., those parts of the fleece which are to be converted into intermediate portions 12 need not undergo any compacting action or are compacted to a negligible or relatively small extent. This enhances the smoothness, suppleness and absorbency of the embossed textile material 1'. The intermediate portions 12 can and preferably do constitute the major part of the embossed textile material 1'.

The knobs 7 in neighboring rows of such knobs on the roll 3 are staggered relative to each other, and the same holds true for the rows of knobs 8 at the periphery of the roll 4. This ensures that the depressions 9 in successive axially parallel rows of such depressions in the peripheral surface of the roll 3 can receive the oncoming knobs 8 of the roll 4, and that the depressions 10 in successive axially parallel rows of such depressions in the peripheral surface of the roll 3 can receive the oncoming knobs 8 while such depressions and knobs advance toward and through the nip N.

The thickness of embossed textile material 1' (i.e., the distance between the planes of compacted portions 11 and 11') can be varied within a wide range by the simple expedient of replacing the illustrated rolls 3 and 4 with pairs of rolls having knobs of greater or lesser height, as measured radially of the respective rolls. Those portions of internal surfaces 8*a* and 7*a* which respectively confront the top lands 5 and 6 of the knobs 7 and 8 during travel through the nip N are preferably smooth and flat, and the same preferably applies for the top lands 5 and 6 of the knobs 7 and 8. This enhances the quality of finish of exposed sides of compacted portions 11 and 11' of the embossed textile material 1' into which the fleece 1 is converted as a result of advancement through the nip N.

The flanks 13 of the knobs 7 and 8 diverge in directions from the respective top lands 5, 6 toward the respective root portions 7A and 8A. The angles of divergence are defined by the flanks 13 and those radii R of the respective rolls which extend through the centers of the corresponding knobs 7 and 8. The angles of divergence of the flanks 13 are preferably between 15° and 45°, more preferably between 20° and 30°, and most preferably approximately 30°. The angle of divergence of the flank 13 on each knob 7 preferably matches or closely approximates the angle of divergence of each knob 8; this ensures that the width of annular clearances between the flanks 13 and the adjacent portions of internal surfaces 7*a* and 8*a* is at least substantially constant Such clearances receive the fluffy intermediate portions 12 of embossed textile material 1'.

Figure 2:
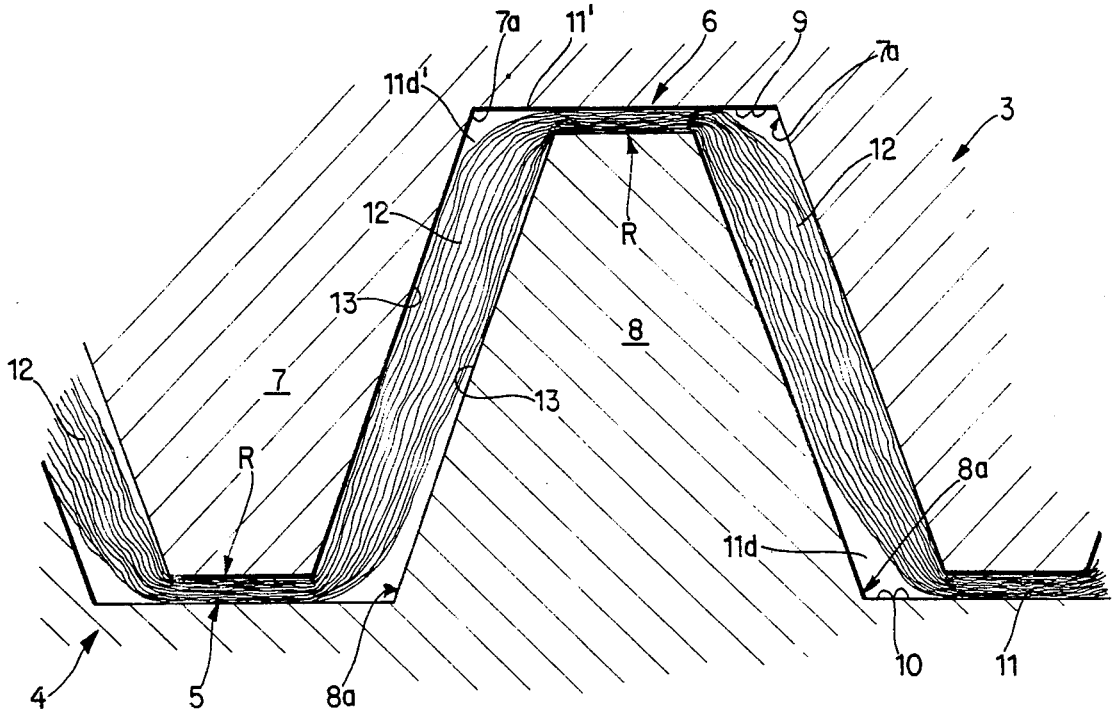
FIG. 2 is a greatly enlarged central sectional view of the embossing rolls within the phantom-line circle I of FIG. 1, showing the manner in which selected portions of the fleece are converted into two sets of coplanar compacted portions and fluffy intermediate portions which connect the compacted portions of one of the layers with the compacted portions of the other layer.
Figure 4:
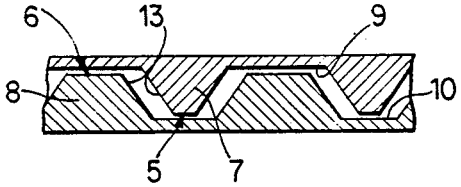
FIG. 4 is a sectional view similar to that of FIG. 2 but showing knobs and depressions of the type shown in FIG. 3.

FIG. 2 shows flanks 13 having angles of divergence of approximately 20°, and FIG. 4 shows flanks 13 having angles of divergence of slightly more than 30°, preferably approximately 35°.

Figure 6:
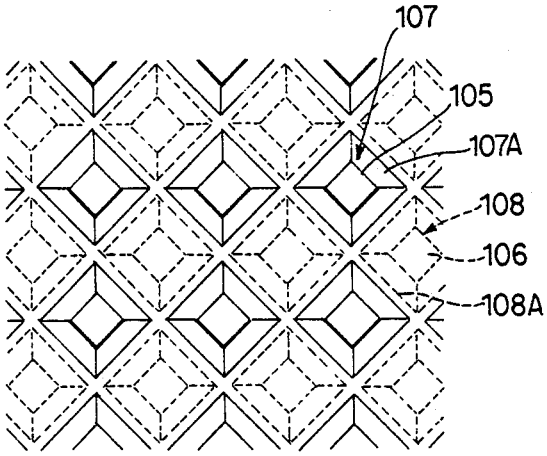
FIG. 6 is a fragmentary developed view of two modified embossing rolls in a representation similar to that of FIG. 3.
Figure 7:
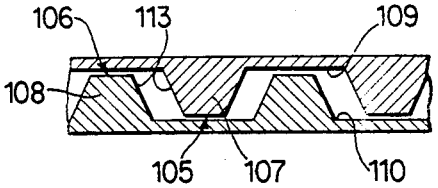
FIG. 7 is a sectional view similar to that of FIG. 4 but showing portions of rolls of the type illustrated in FIG. 6.

The angles of divergence of flanks 113 which are shown in FIG. 7 are less than 30°, preferably close to 25°. The exact inclination of flanks 13 or 113 relative to the respective top lands 5, 6 and 105, 106 depends upon the desired inclination of fluffy intermediate portions 12 with reference to the planes of the compacted portions 11 and 11' The height of the knobs 7 and 8 or 107, 108 (FIGS. 6, 7) (in the radial direction of the respective rolls) can also influence the selection of angles of divergence of the flanks 13 and 113.

FIG. 6 shows patterns of knobs 107 and 108 each of which has a substantially square root portion 107A, 108A. The diagonals of the outlines of such root portions are disposed at right angles to each other, one diagonal is parallel to the axis of the respective roll and the other diagonal extends at right angles to such axis.

The knobs 7 and 8 of FIGS. 2 to 4 constitute truncated pyramids or pyramidal frusta having rectangular (i.e., elongated) top lands 5 and 6, the top lands 5 being normal to the axis of the roll 3 and the top lands 6 being parallel to the axis of the roll 4. The knobs 107 and 108 also constitute truncated pyramids but the top lands 105, 106 of such knobs are square and, as already mentioned above, the diagonals of square outlines of the root portions 107A, 108A of such knobs are normal to each other and extend in parallelism with the axes of the respective rolls or at right angles to the corresponding axes. FIG. 7 shows the clearances with which the knobs 107, 108 extend into the respective depressions 110, 109.

Figure 9:
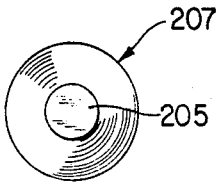
FIG. 9 is a plan view of a first frustoconical knob.
Figure 10:
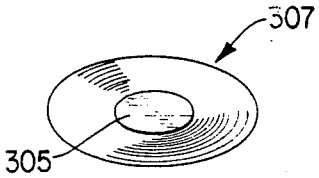
FIG. 10 is a plan view of a modified frustoconical knob.

FIG. 9 shows a knob 207 which is a conical frustum and has a circular top land 205. FIG. 10 shows a somewhat deformed frustoconical knob 307 having an oval top land 305. Knobs of the type shown in FIG. 9 constitute modifications of the knobs 107, 108 (i.e., they can be said to constitute truncated pyramids with flanks consisting of an infinite number of facets). Knobs of the type shown in FIG. 10 constitute modifications of the knobs 7 and 8, (i.e., they can be said to constitute truncated pyramids with flanks consisting of an infinite number of facets).

Knobs of the type shown in FIGS. 3 and 10 are preferred if the embossed textile material 1' is to imitate a woven textile material with interlaced crossing weft and warp threads. Such effect is achieved by employing knobs which are provided with elongated top lands (5, 6, 305) one-half of which extends in parallelism with the axes of the embossing rolls and the other half of which extends at right angles to such axes.

The length of top lands 5 may but need not match the length of top lands 6. Such knobs can be used to provide the embossed textile material 1' with a pattern of compacted portions 11 and 11' in imitation of a coarsely woven fabric wherein the length of visible portions of warp threads exceeds the length of visible portions of weft threads or vice versa.

It is further clear that the knobs 7, 8 of the type shown in FIG. 3 can be arrayed in a manner as shown in FIG. 6, i.e., so that the elongated top lands 5 and 6 are inclined with reference to the axes of the rolls 3, 4 as well as with reference to planes extending at right angles to such axes. By the same token, the pattern of knobs 107, 108 which are shown in FIGS. 6 and 7 can be altered so that the diagonals of the outlines of root portions 107A and 108A are inclined with reference to the axes of the respective rolls as well as with reference to a plane which is normal to such axes.

An important advantage of the improved machine is that the embossing rolls need not be finished and/or otherwise treated with a very high degree of precision. This is due to the fact that each knob extends into the respective depression with a certain amount of clearance along the entire top land as well as around the entire flank of such knob. Many presently known embossing rolls must be machined with a much higher degree of precision because the top lands at the periphery of one of the rolls must actually contact the smooth peripheral surface of the other roll (if no material is fed into the nip of such rolls), or because the top lands of knobs on one of the rolls must strike the top lands of knobs on the other roll when no material is fed into the nip of the two rolls. All that counts in the improved machine is to ensure that the clearances around the flanks 13 or 113 of knobs on the embossing rolls are greater than the clearances along the top lands of the knobs in order to ensure that the intermediate portions 12 of embossed textile material 1' exhibit a desirable fluffiness as a result of minimal compacting during travel through the nip of the embossing rolls or as a result of the absence of any compacting.

Figure 8:
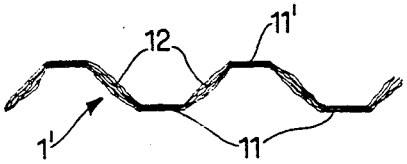
FIG. 8 is a sectional view of an embossed textile material which can be formed in a machine embodying the rolls of FIGS. 6 and 7.

Another important advantage of the improved embossing machine is that the inclination of fluffy intermediate portions 12 relative to the planes of the compacted portions 11 and 11' (see particularly FIGS. 5 and 8) ensures that the absorbency of embossed textile material 1' (converted fleece 1) increases in response to deformation, namely in response to a reduction of the thickness of the material 1' as a result of a reduction of the distance between the planes of the compacted portions 11 and 11'.

The extent to which the portions 11 and/or 11' of textile material 1' are compacted depends upon the thickness of the fleece 1, upon the selected width of clearances between the top lands of the knobs and the adjacent portions of internal surfaces bounding the respective depressions, upon the extent to which at least one of the rolls is heated (it is possible to heat one of the rolls in a manner as shown in FIG. 1, to heat both rolls, or to heat the other roll) and/or upon the nature of solvent (if any) which is applied to those parts of the fleece 1 which are to be converted into compacted portions 11 and 11'. Heating of one or both rolls can result in welding of thermoplastic filaments which form the compacted portions 11 and 11' so that such compacted portions can exhibit a selected amount of rigidity which is desirable to protect the fluffy intermediate portions 12.

A further important advantage of the improved machine is that the material which is fed into the nip N of the embossing rolls need undergo any preliminary treatment (excepting the application of a solvent, if necessary) and that the textile material 1' which issues from the nip N need not be subjected to any additional (secondary) treatment. This entails a considerable reduction of the cost of the material 1' because a carpet of fleece 1 can be directly converted into a textile material which exhibits a desired thickness and other desirable characteristics, such absorbency, smoothness, softness and suppleness.

As can be seen, for example, in FIG. 2, the marginal portions of compacted portions 11 and 11' can extend slightly beyond the outlines of the respective top lands (5 and 6) so that each compacted portion 11, 11' can be said to resemble a shallow tray or pan with raised marginal portions. This enhances the stability and rigidity of the compacted portions 11 and 11' so that they can satisfactorily protect the fluffy intermediate portions 12. Such reinforcement of marginal portions of the compacted portions 11 and 11' is enhanced by the aforediscussed inclination of intermediate portions 12 with reference to the planes of the compacted portions 11 and 11'. Reinforcement takes place in the regions surrounding the deepmost parts of the aforediscussed hollow bosses which are formed by the two sets of knobs and have bottom walls constituted by the compacted portions 11 and 11'. The reinforcement is more pronounced in the interior than at the exterior of the hollow bosses because the outermost filaments which surround the marginal portions of the compacted portions 11 and 11' are not in contact with the adjacent portions of internal surfaces which surround the depressions. This can be readily seen in FIG. 2, as at **11*d* and 11d'**.

Eventual flexing or bending of embossing rolls, especially of median portions of the rolls, either as a result of advancement of fleece 1 through the nip N or as a result of sagging of median portions under the weight of the rolls, can be counteracted by appropriate selection of the width of clearances along the top lands of the knobs. The magnitude of deforming forces is less pronounced than in conventional machines because the top lands of the knobs need not strike against the surfaces in deepmost portions of the respective depressions when the admission of fleece 1 into the nip N is interrupted. This reduces the cost of the rolls. However, it is equally within the purview of the invention to design the knobs in such a way that the top lands of knobs actually contact the bottom surfaces in the respective depressions when the admission of fleece 1 in to the nip N is interrupted. All that counts is to ensure that the embossed textile material 1' will comprise intermediate portions 12 of pronounced fluffiness because the width of clearances along the flanks of the knobs suffices to ensure that the material of the fleece in such clearances is not compacted at all or is subjected to negligible or minimal compacting action, at least as compared with compacting of those parts of the fleece which are converted into the compacted portions of textile material 1'. The only deformation to which those parts of the fleece 1 which are to form the intermediate portions 12 are subjected is that which is necessary to change the orientation of filamentary material around the flanks of the knobs so that the thus reoriented filaments form hollow intermediate portions which are preferably inclined with reference to the planes of the compacted portions 11 and 11'.

The improved machine exhibits the additional advantage that it can convert a fleece into textile material which can be put to use (e.g., in diapers) irrespective of which of its sides is exposed. This is due to the fact that the quality of one side of the material 1' matches the quality of the other side.

The provision of knobs with flanks which diverge in directions from the respective top lands toward the respective root portions is desirable and advantageous on the additional ground that this ensures a relatively smooth transition from the marginal portions of compacted portions 11 and 11' into the adjacent zones of the fluffy intermediate portions 12.

The utilization of knobs which constitute truncated pyramids is desirable and advantageous on the ground that such knobs can be distributed along the peripheries of the respective rolls with a high degree of uniformity. This can be readily seen in FIGS. 3 and 6. On the other hand, knobs which are or which resemble conical frusta (FIGS. 9 and 10) can be readily machined with a high degree of precision and at a relatively low cost.

The cost of making the improved rolls is considerably less than the cost of rolls with knobs which confront each other, either fully or in part, during travel through the nip. This holds particularly true if the rolls are provided with large numbers of relatively small knobs.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for embossing a fleece of fibrous material, comprising first and second rotary embossing rolls defining a nip for the fibrous material and having peripheral surfaces provided with spaced apart knobs forming depressions, the knobs of said first roll extending with clearance into the depressions of said second roll and the knobs of said second roll extending with clearance into the depressions of said first roll during travel of said knobs and said depressions through the nip, said knobs having top lands and flanks and said rolls having internal surfaces bounding said depressions, clearances between respective flanks of the knobs of said first and second rolls being greater than clearances between said top lands and the internal surfaces bounding the respective depressions during travel of said knobs and said depressions through said nip; and means for rotating said rolls so that the rolls rotate in opposite directions said rotating means including means for positively driving at least one of said rolls.

2. The machine of claim 1, wherein said rolls have substantially parallel axes.

3. The machine of claim 1, wherein at least a portion of each of said internal surfaces is smooth.

4. The machine of claim 1 for embossing a fleece having a predetermined thickness, wherein the width of clearances between the respective flanks of the knobs of said first and second rolls equals or approximates said predetermined thickness.

5. The machine of claim 1, wherein each of said knobs has a root portion remote from the respective top land, said flanks having an angle of divergence in a direction from the top lands toward the root portions of the respective knobs.

6. The machine of claim 5, wherein the angles of divergence of all flanks are the same.

7. The machine of claim 6, wherein the width of clearances between respective flanks of the knobs of said first and second rolls is substantially constant.

8. The machine of claim 5, wherein the angle of divergence of said flanks with reference to the radii of said rolls through the centers of the respective knobs is between 15° and 45°.

9. The machine of claim 8, wherein said angle is between 20° and 30°.

10. The machine of claim 1, wherein at least some of said knobs are pyramids.

11. The machine of claim 1, wherein at least some of said knobs are cones.

12. The machine of claim 1, wherein at least some of said knobs are pyramidal frusta and the top lands of said at least some knobs have a substantially rectangular cross-section.

13. The machine of claim 1, wherein at least some of said knobs are conical frusta and the top lands of said at least some, knobs have a substantially circular cross-section.

14. The machine of claim 1, wherein said knobs have root portions remote from the respective top lands and at least some of said root portions have a square or rectangular outline with a diagonal extending in substantial parallelism with the axis of the respective roll.

15. The machine of claim 1, wherein the top lands of said knobs are elongated and the top lands of knobs on one of said rolls are inclined with reference to the top lands of knobs on the other of said rolls.

16. The machine of claim 1, wherein the top lands of knobs on one of said rolls are substantially normal to the top lands of knobs on the other of said rolls.

17. The machine of claim 15, wherein the top lands of knobs on said-one roll are substantially normal to the axis of said one roll and the top lands of knobs on said other roll are substantially parallel to the axis of said other roll.

18. The machine of claim 1, wherein said knobs have root portions remote from the respective top lands and at least some of said root portions have a square or rectangular outline with two diagonals which are inclined with reference to the axis of the respective roll.

19. The machine of claim 18, wherein said diagonals are further inclined with reference to a plane which is normal to the axis of the respective roll.

20. The machine of claim 1, wherein at least some of said knobs are conical frusta and the top lands of said at least some knobs have substantially oval cross-section.

* * * * *